United States Patent [19]

Lammers

[11] Patent Number: 5,020,973

[45] Date of Patent: Jun. 4, 1991

[54] AIR COMPRESSOR SHROUD

[75] Inventor: James B. Lammers, Cleves, Ohio

[73] Assignee: The Scott & Fetzer Company, Lakewood, Ohio

[21] Appl. No.: 462,779

[22] Filed: Jan. 10, 1990

Related U.S. Application Data

[62] Division of Ser. No. 252,695, Oct. 3, 1988, Pat. No. 4,915,594, which is a division of Ser. No. 856,645, Apr. 25, 1986, Pat. No. 4,801,250.

[51] Int. Cl.[5] ..... F04B 1/02; F04B 39/06

[52] U.S. Cl. ..... 417/243; 417/256; 417/265

[58] Field of Search ..... 417/243, 254, 256, 265, 417/372, 415, 423.8, 521

[56] References Cited

U.S. PATENT DOCUMENTS

| | | | |
|---|---|---|---|
| Re. 17,457 | 10/1929 | Davey et al. | 417/372 |
| 1,528,172 | 3/1925 | Voss . | |
| 1,605,986 | 11/1926 | Redfield . | |
| 1,799,103 | 3/1931 | Klimek . | |
| 1,973,218 | 9/1934 | Mikulasek . | |
| 2,136,097 | 11/1938 | Browne . | |
| 2,243,123 | 5/1941 | Ritter . | |
| 2,294,619 | 9/1942 | Kastler . | |
| 2,312,335 | 3/1943 | Halleck | 417/243 |
| 2,464,560 | 3/1949 | Davey | 417/243 |
| 2,562,954 | 8/1951 | Schmidlin . | |
| 2,576,876 | 11/1951 | Gamble | 417/243 |
| 2,899,130 | 8/1959 | Sykes . | |
| 2,917,226 | 12/1959 | Scheiterlein | 417/372 |
| 2,984,408 | 5/1961 | Nicholas . | |
| 3,045,898 | 7/1962 | Hilfing et al. . | |
| 3,109,451 | 11/1963 | Mihalakis . | |
| 3,400,885 | 9/1968 | Enemark et al. . | |
| 4,190,402 | 2/1980 | Meece et al. | 417/415 |
| 4,784,585 | 11/1988 | Hata et al. | 417/372 |
| 4,801,250 | 1/1989 | Lammers . | |
| 4,801,254 | 1/1989 | Eiermann . | |
| 4,830,591 | 5/1989 | Eiermann et al. . | |
| 4,834,634 | 5/1989 | Ono . | |

FOREIGN PATENT DOCUMENTS

| | | | |
|---|---|---|---|
| 0595221 | 3/1925 | France | 417/521 |

*Primary Examiner*—Leonard E. Smith
*Assistant Examiner*—Eugene L. Szczecina, Jr.
*Attorney, Agent, or Firm*—Wood, Herron & Evans

[57] ABSTRACT

A V-twin, two-stage compressor has valve plates disposed between the head and cylinder of each stage and mounting free-floating flexible read intake and exhaust valves therein. The flexible reeds are movably captured between the floors of respective reed recesses, and separate, non-fixed keeper bars are disposed over, but slightly spaced from, the reeds. Keeper bars over the exhaust reed extend above the valve plate for engagement by the head. A restrictor plate lies within a valve plate recess on keeper bars over the intake valve. A cored crankshaft providing motor drive shaft lubrication, and a removable counterweight providing crankshaft use with one-piece connecting rods is disclosed. A cooling fan is driven by the removable counterweight and V-shaped fan shroud projections direct cooling air over the cylinders and heads while another cooling air port directs air over an intercooler. An intake manifold having a plurality of intake tubes and rib and wall structure for an air filter dividing the chamber both filters air and muffles compressor noise.

1 Claim, 7 Drawing Sheets

AIR COMPRESSOR SHROUD

This is a division, of application Ser. No. 07/252,695, filed Oct. 3, 1988, now U.S. Pat. No. 4,915,594, which is, in turn a divisional of U.S. patent application Ser. No. 06/856,645, filed Apr. 25, 1986, now U.S. Pat. No. 4,801,250.

The efficiency and reliability of an air compressor are generally functions of a number of factors, primarily having to do with the way air is moved, and its temperature controlled, throughout the process.

This invention relates to air compressors and more particularly to improvements in the valving, intake manifolds, crankshafts and to cooling of air in air compressors, which improve efficiency and reliability and which reduce operating noise.

A typical, industrial quality air compressor may currently be of the two-stage type wherein air is first compressed in one cylinder, then transferred to another cylinder from where it is moved to a receiver. Such cylinders may be oriented in a "V" configuration, and driven by a belt driven pulley, for example, at a speed of about 900 to 1000 rpm.

In the past, such compressors have used, among other arrangements, valve plates disposed between the cylinder and cylinder head to provide appropriate intake and exhaust valving for that cylinder. While various types of valves have been used in connection with such plates, it is common to find reed valves mounted thereon. Such reed valves are generally a flexible reed of metal, fixed at one end to the valve plate or associated cylinder head for closing appropriate ports in the head or valve plate as air is compressed from or drawn into the cylinder.

In another known reed valve configuration, a reed valve lies freely over a port in a valve plate and a curved valve stop surface in the head lies above the reed to stop it when air blows through the port. In these devices, the head is separated from the valve plate by a gasket and the ends of the reed valve are prone to chew away at the gasket, work their way into the gap between head and plate, and become pinched. Further compressor operation flexes the reed around its "pinch point" and between the head and plate, and the reed can prematurely fail, severely reducing compressor reliability. Another disadvantage of this construction is that fluttering valve ends can cut grooves in the head stop surfaces. The reed can work itself into these wear grooves and find itself then locked in the wear zone it has cut out, in an open position spaced away from its associated port.

In another type of known device, a reed is positioned over a raised port in a valve plate, and an integral, concave stop bar is disposed on the valve plate over the reed. The stop bar, at its ends, captures the flexible reed over the raised port and may or may not touch the reed when it is closed. Air pressure in the port flexes the reed open. Such stop bar configuration, because of its shape, is difficult and expensive to use where it must be hardened. It also requires separate fasteners which lead to assembly difficulties.

Moreover, it is believed that compressors of the type noted, i.e., two-stage, twin-cylinder compressors of about 5 horsepower, for example, are generally run at about 900-1000 rpm, or less, by a belt and pulley drive, for example, and produces about 16.5 cfm at 175 psi. It is desirable, however, to provide a compressor of much more compact and lighter construction, while retaining a similar output. While it may be possible to retain such similar output in a smaller compressor operating at higher speeds, it has been found that valve structures such as the reed valves mentioned above, which function sufficiently at lesser speeds, cannot handle such higher speeds. When run at higher speeds, such valves produce less efficient results, fail prematurely, or both. Thus, the selection of a valve structure for a compressor having an increased output is considerably complicated by the inherent disadvantages of the prior structures noted above, or by their inability to efficiently handle increased operating speeds, or both.

It has accordingly been one objective of this invention to provide an improved reed valve for an air compressor.

A further objective of the invention has been to provide an improved valve plate and valves for use with an expansible chamber and head.

A further objective has been to provide an efficient, long-lasting reed valve for a compact, twin cylinder, two-stage air compressor operating at about 1725 rpm and producing about 16.5 cfm at about 175 psi.

One consideration in the manufacture of piston type air compressors is the construction of the crankshaft, which must be dynamically balanced, and the simultaneous desirability of using a one-piece piston connecting rod.

In order to most optimally dynamically balance a crankshaft used in a V-twin compressor, it is generally necessary to provide a crankshaft with counterweights at each end thereof. This necessitates, however, the use of two-piece connecting rods since it is generally not possible to slip such a double weighted crankshaft through a one-piece connecting rod for assembly. Use of a two-piece connecting rod increases the possibility of a loose screw or other part in the crankcase, failure of the connecting rods, or both. This can severely reduce reliability.

Accordingly, it has been a further objective of the invention to provide an improved crankshaft for a compressor, which can be dynamically balanced with counterweights at both ends, yet can be used with one-piece piston connecting rods.

Where it is desired to provide a direct drive compressor, the coupling between the motor drive shaft and the compressor crankshaft can be the source of several problems. In one configuration, as an example of one problem, the motor drive shaft is screwed into the crankshaft. Through time and many operational cycles, the drive shaft and crankshaft interact to produce "fretting" corrosion. This makes it extremely difficult to separate the two parts for maintenance or parts replacement.

Accordingly, it has been one objective of the invention to provide an improved crankshaft and for preventing fretting or corrosion between the crankshaft and a motor drive shaft.

Moreover, where a cooling fan is to be used in conjunction with the compressor, means to mount and drive the fan must also be considered.

In a typical belt driven compressor, a driven pulley serves dual purpose. It provides a speed reducer, its spokes operate as a cooling fan. Where a direct drive motor and compressor configuration is to be utilized, in lieu of a belt drive and fan pulley, the compressor crankshaft can also be used to drive a cooling fan.

In this regard, it has been a further objective of the invention to provide an improved cooling fan drive for a direct drive compressor.

It has been a further objective of the invention to provide an improved cooling fan drive in a direct drive air compressor together with an improved compressor crankshaft.

It has been a still further objective of the invention to provide an improved direct drive compressor crankshaft for preventing fretting or corrosion between the crankshaft and a drive shaft, which can be dynamically balanced by means of counterweights on opposite sides of a one-piece piston connecting rod and which provides an improved direct drive fan or cooling fan.

When a fan is used with a compressor for cooling, it is desirable to maximize its cooling efficiency. Air directing shrouds have been used for this purpose. It has been, however, a further objective of this invention to provide an improved fan shroud and compressor wherein cooling air is even more efficiently handled.

Air compressors frequently utilize intake manifolds for the purpose of both filtering air or for muffling the noise generated by the compressor. The combination of elements to provide both appropriate filtering and desirable muffling performance is frequently elusive.

Accordingly, it has been a further objective to provide an improved intake manifold for both filtering incoming air to be compressed and for muffling compressor noise.

To these ends a preferred embodiment of the invention includes an improved valve and valve plate for use between the cylinder and cylinder head of a compressor. The valve plate is provided with at least one free-floating reed valve therein. The new reed valve is not held, pinched or biased into any particular position, but is free to float between a closed position over an exhaust port, for example, in the plate, and an open position where portions of its end areas engage respective hardened and radiused keeper bars lying transversely over the reed. There is more vertical space between the keeper bars at the floor of the reed valve recess on the valve plate than the reed is thick, thereby providing its free-floating condition.

Since the keeper bars are relatively small and constitute parts which are not an integral part of the head, the valve plate or any restrictor plate, they can be easily hardened and thus eliminate the necessity and expense of hardening the much larger head or valve plate, for example.

The keeper bars lie in recesses which are shallower than the thickness of the bars. Thus, the bars extend above the surface of the valve plate. The head is provided with keeper bar engaging surfaces and a concave reed stop surface contoured to receive the opening reed, and grooved to permit air to cross over the reed to the exhaust port from the head.

An elongated silicone seal is disposed preferably in a groove extending peripherally around the head and seals against the valve plate, when the head is assembled to the valve plate, once the keeper bar engaging surfaces engage the keeper bar. These surfaces are in the same general plane as other head surfaces mating with the valve plate and may not touch, except at the points where the head bolts are located. Nevertheless, the seal effectively seals the head and valve plate together once the head engages the keeper bars.

On the intake side, the valve plate is provided with an intake valve recess receiving a free-floating reed valve similar to that of the exhaust side. This intake valve is similarly captured, in a free-floating condition, by hardened and radiused keeper bars lying in channels and transversely spaced over the reed.

A restrictor plate recess is also provided in the intake side, and a ported restrictor plate is disposed therein for securing the keeper bars over the intake reed and serving as a reed stop. The restrictor plate has a portion extending beyond the open cylinder bore below it so as to itself be held in place by surfaces surrounding the cylinder at its upper end.

As in the exhaust side, the intake reed keeper bars are thicker than their receiving channels are deep. The restrictor plate has surfaces engaging these bars before the restrictor plate bottoms out in its recess. The engagement of the restrictor plate by the upper cylinder surfaces thus retains the keeper bars in proper position, capturing the intake reed in its recess in operative relationship with an intake port in the valve plate.

An elongated silicone seal is disposed in a groove in the intake side of the valve plate. This seal engages surfaces on the upper end of the cylinder and seals the valve plate and cylinder when the plate is assembled thereover and the restrictor plate is bottomed on the keeper bars.

The valve plate and valves so described are capable of operating at high speed cycles of, for example, 1725 compressions per minute. The free-floating valves are not pinched, and not required to flex along a fixed "hinge line," but rather free float and provide a lengthy service life even at the noted high speed operation. The valves are very easy to replace, and there are no rivets or screws to remove, or to fall into the cylinder.

In another aspect of the invention, an improved compressor crankshaft is cored or hollowed out, and has an integral counterweight provided at a driven end thereof. For direct drive, the crankshaft drive end is bored out and threaded to receive the drive shaft of a motor. According to a preferred embodiment of the invention, the bore of the drive end of the crankshaft extends through said crankshaft to the hollowed out area. This area is opened, through large portals in the crankshaft within the crankcase, and oil from the crankcase is transmitted to the internal threaded area connecting the crankshaft with the drive shaft. This lubricates the threaded drive connection and prevents fretting or corrosion.

The cored crankshaft is preferably provided with an integral counterweight on its driven end, but no integral counterweight on the other end. This other end can easily be slipped into a one-piece piston connecting rod. A removable counterweight is disposed on this same other end, after connecting rod assembly. Thus, the crankshaft can be balanced through the use of counterweights on two ends, yet still accommodates a one-piece connecting rod.

A fan is mounted on the drive axis provided by the end of the crankshaft to which the removable balance counterweight is mounted. According to the invention, a fan drive pin extends from the removable counterweight at a position radially spaced from the drive axis and engages the fan to drive it as the crankshaft and counterweight rotate. This provides a positive fan drive through the nevertheless removable counterweight.

In another aspect of the invention, a shroud is provided to direct air into and from the fan over the cylinders and cylinder heads in a V-shaped configuration. Deflectors are provided in conjunction with air exhaust ports mounted in shroud projections of a V-shaped shroud backplate to direct cooling air over the heads and cylinders.

An intercooler provides a compressed air passage leading from one cylinder to the other, i.e., from the first to the second stage. The intercooler is in a wound or spiral configuration and is disposed behind the shroud backplate. An orifice is disposed in the backplate, between the cylinder cooling exhausts, and is in register with the intercooler to direct cooling air over it and cool the first stage air as it moves into the second stage.

In still another aspect of the invention, an intake manifold comprises a chamber defined by a shroud and a backing plate. The chamber is divided into two portions by two sets of ribs extending from the backing plate to the shroud. The sets of ribs define between them a slot for receiving a foam type air filter. Opposed walls mounted on elongated edges of the ribs close off the chamber portions from each other, excepting an air passageway between the forward wall edges spaced from, but near, the shroud side of the chamber.

A plurality of open air inlet tubes extend into a first chamber portion from said shroud to a position spaced from but proximate to the backing plate. An air outlet port is disposed in the second chamber portion for conducting filtered air to the first stage of the compressor. The combination of the tubes and the chamber portions serve to efficiently muffle compressor noise.

These and other objectives and advantages will become readily apparent from the following written description of the invention and from the drawings in which.

Figure 1:
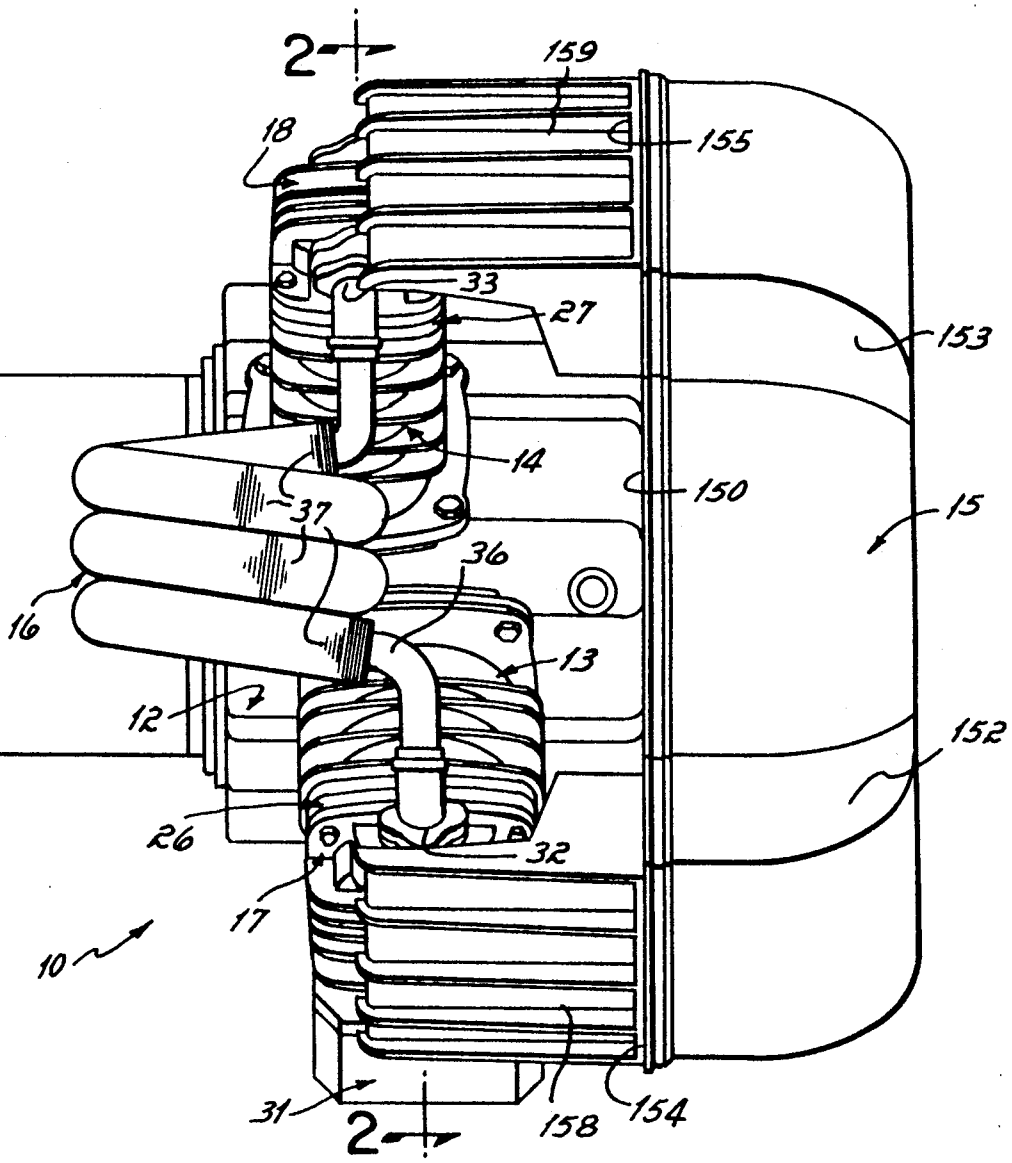
FIG. 1 is a top plan view of a V-twin, two-stage, air compressor according to a preferred embodiment of the invention.

Turning now to the drawings, there is shown in FIG. 1 thereof a compressor 10 according to a preferred embodiment of the invention. Compressor 10 includes a drive motor 11, a crankcase 12, two cylinders 13 and 14 mounted on the crankcase 12, and a cooling fan shroud 15.

According to a preferred embodiment of the invention, and without limitation, compressor 10 is preferably a two-stage air compressor wherein cylinder 13 is a first stage for compressing air from ambient pressure a first elevated pressure and cylinder 14 comprises a second stage for compressing compressed air at the first elevated pressure from the first cylinder 13 to a second and higher pressure. Compressed air from cylinder 13 is transmitted to cylinder 14 for further compression via an intercooler 16. Each of the cylinders 13 and 14 is provided with a respective head 17 and 18.

It will be appreciated that the cylinders 13 and 14 are disposed on the crankcase 12 in a V-shaped configuration, the compressor being commonly referred to then as a V-twin compressor. Also, it will be noted that the motor 11 is preferably directly coupled to the compressor so that the compressor is referred to as a direct drive compressor.

Figure 2:
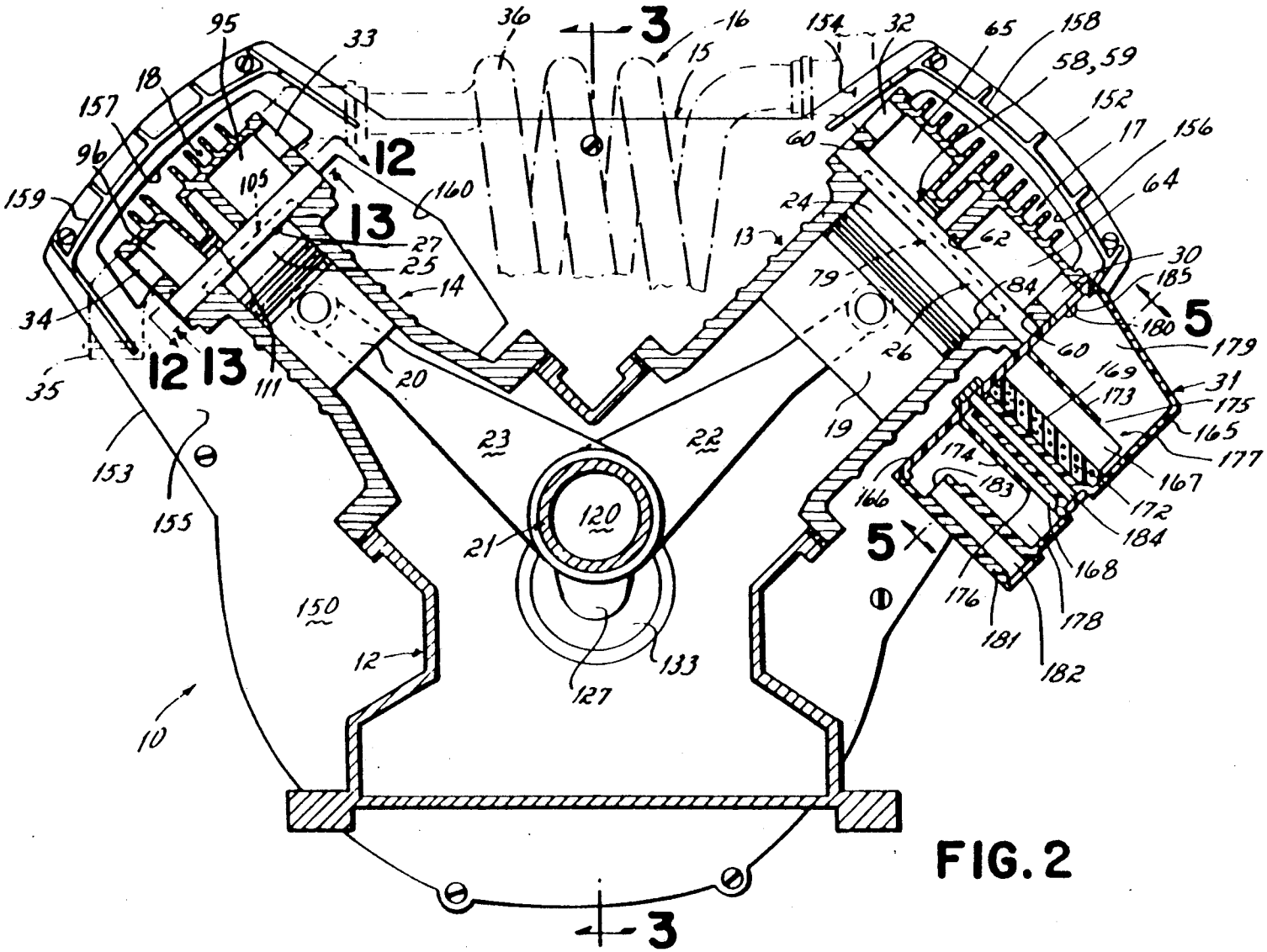
FIG. 2 is a cross-sectional view taken along lines 2—2 of FIG. 1.

As shown in FIG. 2, each of the cylinders 13 and 14 is provided with a respective piston 19 and 20 mounted for reciprocation within the cylinders about a crankshaft 21. A one-piece connecting rod 22 connects piston 19 to the crankshaft 21, while a somewhat similar one-piece connecting rod 23 connects piston 20 to the crankshaft 21. Each of the cylinders and pistons define respective expansible chambers 24 and 25.

It is to be appreciated that the compressor as shown in FIGS. 1 and 2 comprises preferably an industrial quality, V-twin, direct drive compressor, wherein the motor 11 is of any suitable size, and preferably constitutes a 4-pole, 60 cycle motor of about 5 horsepower, and producing an operating rotation of about 1725 rpm, such that each expansion chamber 24 and 25 undergoes about 1725 compression cycles per minute. While compressors of other parameters and characteristics are also contemplated within the scope of this invention, a preferred two-stage compressor has a low pressure or first stage cylinder 13 and piston 19, providing a cylinder bore of about 3.25" diameter and a piston stroke of about 2.63". The high pressure or second stage cylinder 14 and piston 20 provide a bore of about 1.71" diameter and a stroke of about 2.63". When such compressor is run at 1725 cpm, it produces compressed air in a volume of about 16.5 cfm at 175 psi. Features of the invention may be used in other types of compressors, both single and two-stage, direct drive and beltdriven, and of varying power, output and speed.

It should also be appreciated at this point that the normal desired speed of a motor 11, such as a 4-pole motor at 60 cycles is about 1725 rpm. The capacity of the compressor to operate at this speed (and thereby retaining an output of about 16.25 cfm at about 175 psi) eliminates the need for a bulky and weighty speed reducing device. This is a substantial advantage provided by this invention.

Chamber 24 is further defined by a valve plate 26, while the expansible chamber 25, associated with cylinder 14 and piston 20, is further defined by a valve plate 27. With the exception of size, and of the particular port size and configuration in the valve plates, the respective valve plates and heads associated with each of the cylinders 13 and 14 are essentially similar.

It will be further noted that the head 17 includes a first intake port 30 for receiving ambient air from an intake manifold 31. Head 17 further includes an exhaust port 32 for connecting the exhaust from the expansible chamber 24 to the intercooler 16. Head 18 includes an intake port 33 for receiving compressed air from the intercooler 16, and a further exhaust port 34 for transmitting further compressed air from expansible chamber 25 to an outlet duct 35.

As shown in FIG. 1, the intercooler 16 comprises a wound conduit 36 having cooling fins 37 thereon for the purpose of cooling air transmitted through the intercooler 16. Intercooler 16 is in a general spiral configuration as shown in FIGS. 1 and 2, providing an extended path between the compressor stages defined by the expansible chamber 24 and 25, respectively.

Figure 2A:
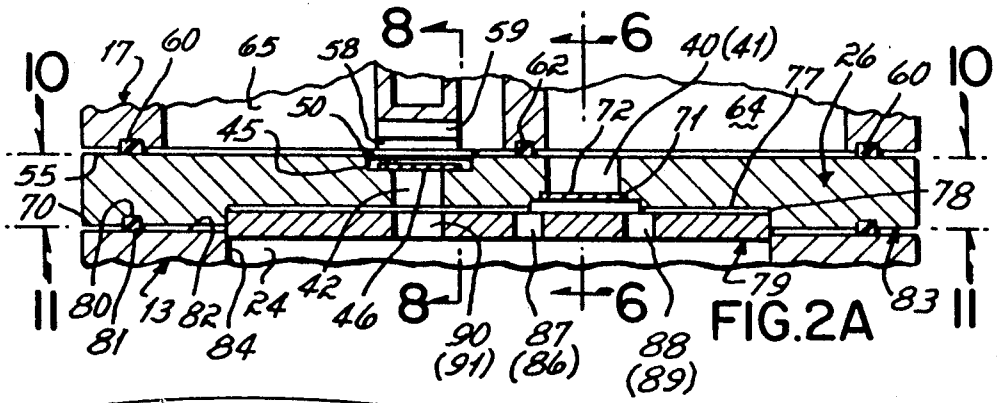
FIG. 2A is a partial enlarged view of the cylinder top, valve plate, and head as shown in the upper right portion of FIG. 2.

For the purpose of clarity and illustration, the valve plate 26 (associated with the cylinder 13), together with the top surfaces of the cylinder and the lower surfaces of the associated head 17 have been shown in an enlarged form in FIG. 2A. Valve plate 26 will now be described.

Figure 10:
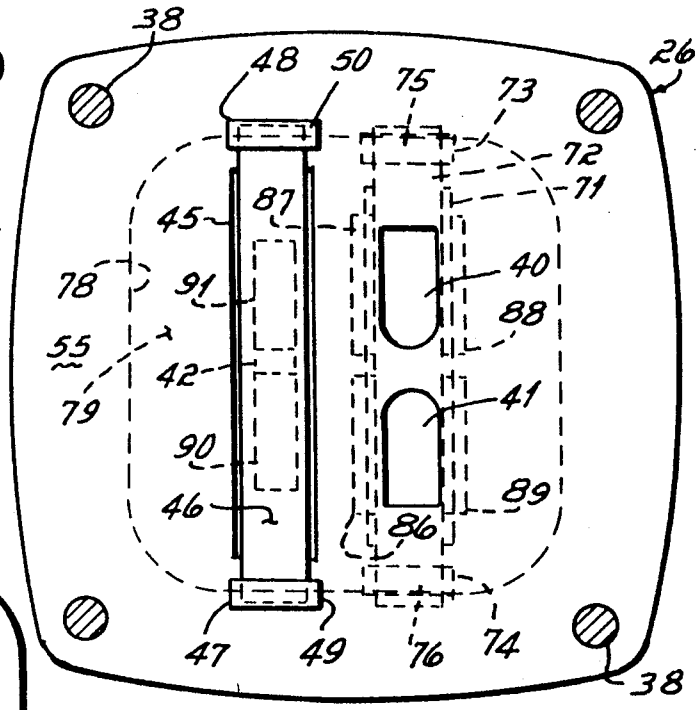
FIG. 10 is a cross-sectional view taken along lines 10—10 of FIG. 2A, looking down onto the valve plate.
Figure 9:
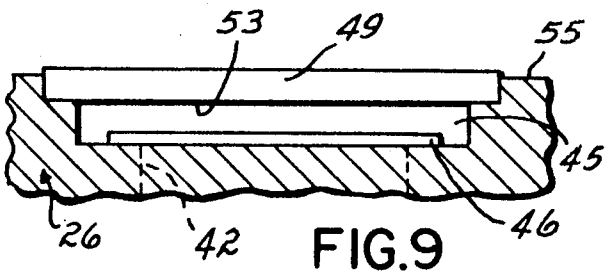
FIG. 9 is a cross-sectional view taken along lines 9—9 of FIG. 8.

Valve plate 26 comprises an essentially flat piece of preferably metallic material having holes, such as holes 38 (FIG. 10), disposed therein for receiving elongated fasteners which secure the head, the valve plate and the cylinder together. As also shown in FIG. 10, plate 26 includes two intake ports 40 and 41 and an exhaust port 42.

Figure 8:
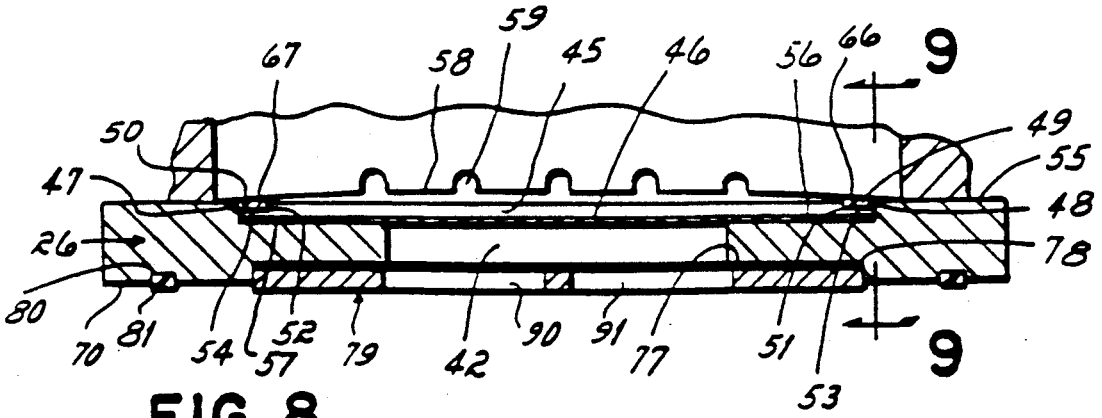
FIG. 8 is a cross-sectional view of the valve plate, exhaust valve and head taken along lines 8—8 of FIG. 2A.

Turning now to FIG. 8, there is provided in the upper or exhaust side of valve plate 26 a first recess 45. Disposed in the recess 45 is a freefloating, flexible reed valve comprising an exhaust valve 46. Transverse recesses or channels 47 and 48 (see also FIG. 10) are cut into the exhaust side of the valve plate in a position where they extend across the reed valve receiving first recess 45. Thus, the second and third recesses 47 and 48 are centrally discontinuous, with only their ends being defined by respective relieved portions in each side of the first recess 45 for receiving the ends of hardened keeper bars 49 and 50.

Each of the keeper bars 49 and 50 has respective corner 51, 52 which is radiused and provides a smooth surface for engagement by the freefloating reed exhaust valve 46. The keeper bars 49 and 50 each have lower surfaces 53 and 54 which extend over the reed valve 46 in such a way that the reed valve, when moved in an upward direction as seen in FIG. 8, can engage the surfaces 53 and 54. Moreover, it will be appreciated that the keeper bars are separate from the head, valve plate or restrictor plate and require no fasteners to retain them in position. It will also be appreciated that the floor of the recess 45 at its ends can be relieved to provide a free flex area for the ends of the reed therein.

It will further be appreciated that the respective recesses 47 and 48 have a predetermined depth which is slightly less than the thickness of the hardened keeper bars 49 and 50. In this regard and as shown in FIG. 8, the keeper bars 49 and 50 extend slightly above the exhaust side 55 of the valve plate 56. In addition, it will be further appreciated that the lower surfaces 53 and 54 of the respective keeper bars 49 and 50 do not normally engage the freefloating reed valve 46 when the reed valve is in a position to cover the exhaust port 42, as shown in FIG. 8. Accordingly, there is a gap between the lower surfaces 53 and 54 of the respective keeper bars 49 and 50 and the reed valve 46 when the reed valve is in its closed position.

When exhaust air is urged upwardly through the exhaust port 42, the reed valve is lifted off that port. End portions 56 and 57 of the reed valve engage the keeper bars 49 and 50 and the radiused edges 51 and 52. Further upward motion of the exhaust air urges the reed valve 46 into contact with a reed stop surface 58 disposed on the head 17.

Reed stop surface 58 is traversed by a plurality of grooves 59 for the purpose of permitting exhaust air to move from one side of the reed valve to the other. For example, and returning momentarily to FIG. 2A, it will be appreciated that exhaust air is moved through port 42 to lift the reed valve 46 from the port. Utilization of the grooves 59 permits air on either side of the reed valve to move through the grooves and out the exhaust side to the exhaust port 32 (FIG. 2). It has been found that grooves 59 prevent torsional twisting or deformation which may otherwise be generated in the flexible reed 46 if there were no air passages over the reed.

Furthermore, it will be appreciated that the surfaces 58 are concave with respect to the head. If the reed is moved off the port 42, it tends to rest in a curved configuration, with the end portions 56 and 57 engaging the smooth radiused corners 51 and 52 of the respective keeper bars 49 and 50.

An elongated, round, silicone seal 60 is formed in a circle and is disposed in a circular seal recess or groove 61 in the head 17. The seal 60 engages peripheral surfaces of the valve plate 26 to seal the head 17 to the valve plate. Likewise, an elongated, round, silicone seal 62 is provided in a straight groove 63 to separate an intake chamber 64 in the head from an exhaust chamber 65 in the head.

Moreover, it will be further appreciated that the thickness of the keeper bars 49 and 50 prevent the head from fully engaging the valve plate 26. More particularly, the head includes keeper bar engaging surfaces 66 and 67, respectively. These keeper bar engaging surfaces are in the same general plane as the remaining peripheral surface areas of the head which would otherwise normally contact and mate with the valve plate 26. Accordingly, when the head is tightened down onto the cylinder and over the valve plate, it will be appreciated that the seals 61 and 62 are operative to form a seal against the valve plate surface prior to the time at which the head actually contacts the valve plate. Thus, the head is seated or bottomed out on the keeper bars 49 and 50. Use of a convention "sheet" type gasket is not believed suitable since such gasket may not compress sufficiently to provide an adequate seal when the head bottoms out on the thick keeper bars.

The valve plate 26 also includes an intake or compression side 70. A fourth recess 71 is disposed in the compression side 70 of the valve plate 26 for receiving therein a free-floating, flexible reed intake valve 72 therein. Similarly to the keeper bar recesses 47 and 48, relieved areas are disposed in the valve plate adjacent the fourth free-floating valve recess. These areas define keeper bar channels or recesses 73 and 74, having hardened radiused keeper bars 75 and 76 disposed therein and transversely over the free-floating flexible reed 72. The thickness of the keeper bars 75 and 76 is slightly greater than the depth of the relieved portions or recesses 73 and 74 in the valve plate such that the keeper bars 75 and 76 extend slightly above the floor 77 of a seventh recess, referred to as a restrictor plate recess 78. A restrictor plate 79 is disposed in the recess 78 and rests on keeper bars 75 and 76, slightly above the floor 77 of the recess 78.

Figure 6:
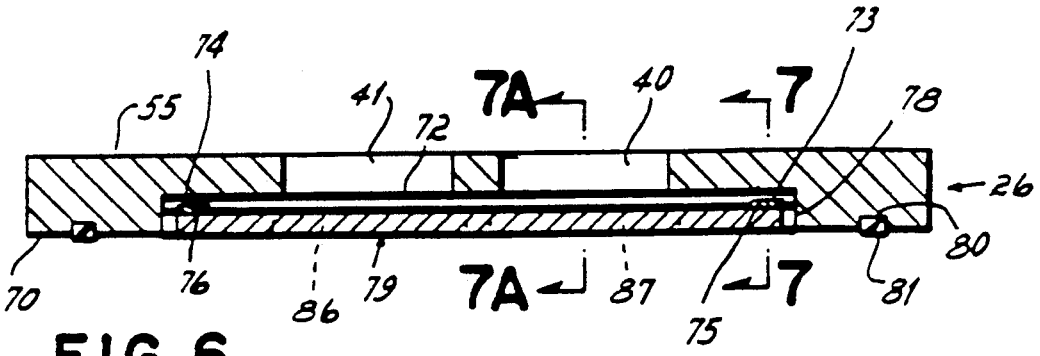
FIG. 6 is a cross-sectional view of the valve plate, intake valve, keeper bars and restrictor plate taken along lines 6—6 of FIG. 2A.
Figure 7:
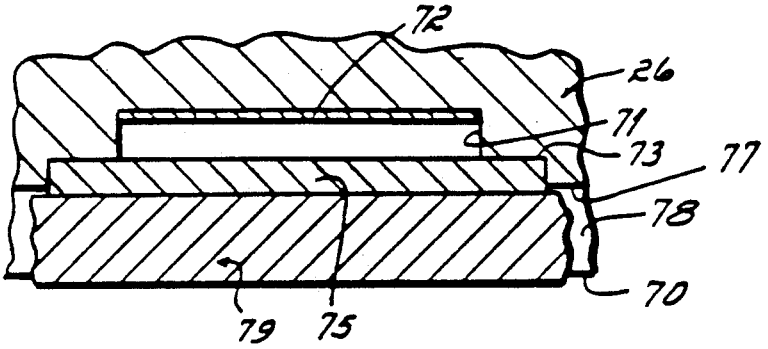
FIG. 7 is a cross-sectional view taken along lines 7—7 of FIG. 6.
Figure 7A:
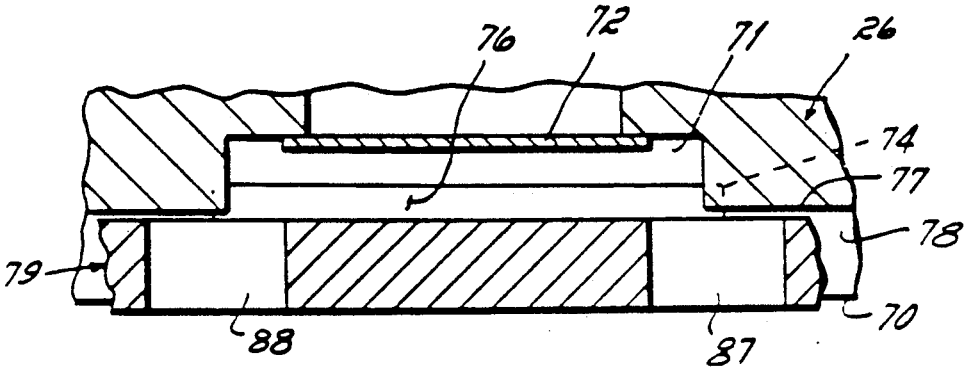
FIG. 7A is a cross-sectional view taken along lines 7A—7A of FIG. 6.

When compression is present on the compression side 70 of the plate 26, the flexible reed valve 72 is urged against the intake ports 40 and 41 to close those ports. This position of the reed 72 is shown in both FIGS. 6 and 7. In this position, it will be noted that there is a gap between the surfaces of the keeper bars 75 and 76 and the flexible reed 72. When the piston 19 begins to retract away from the valve plate 26, the reed 72 is opened away from the ports 40 and 41 such that the reed engages the keeper bars 75 and 76 and can further flex away from the ports 40 and 41 into engagement with the restrictor plate 79. The keeper bars 75 and 76, similarly to the keeper bars 49 and 50, have interior rounded corners for engaging the flexible reed valve to prevent undue wear at the end portions of the reed.

Figure 11A:
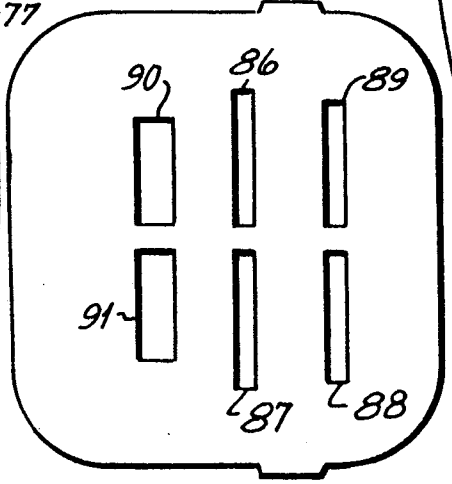
FIG. 11A is a view looking up onto the restrictor plate, omitted for clarity, from FIG. 11.
Figure 11:
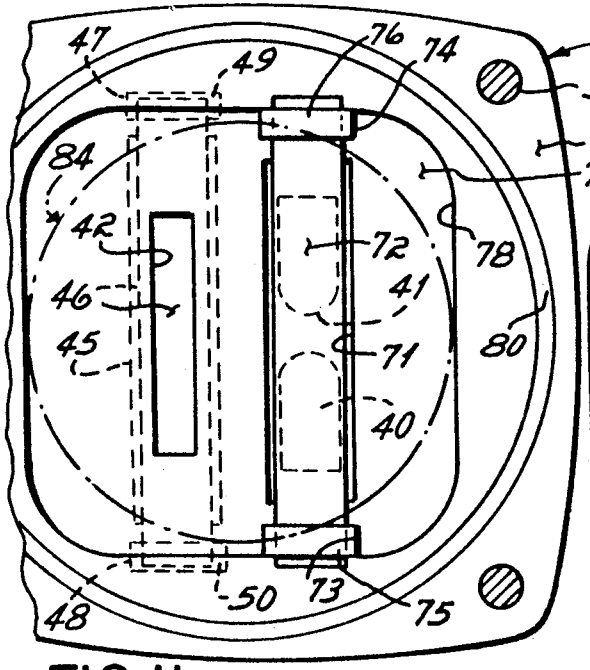
FIG. 11 is a cross-sectional view taken along lines 11—11 of FIG. 2A, looking up onto the valve plate, but without the restrictor plate thereon.

Valve plate 26 is provided with a peripheral groove 80 receiving an elongated, round, silicone seal 81 for engaging upper surfaces 82 and 83 of the cylinder 13 (see FIG. 2A). It will also be appreciated from FIG. 2A and from FIG. 6 that since the restrictor plate is bottomed out on the keeper bars 75 and 76, the thickness of the restrictor plate causes it to project slightly outwardly of the compression side 70 of the plate 26. At least portions of the outer periphery of the restrictor plate 79 extend outwardly of the cylinder bore 84 of the cylinder 13 (FIGS. 2 and 11). This relationship is perhaps best seen in FIG. 11. Accordingly, it will be appreciated that as the valve plate 26 is assembled to the cylinder 13, the restrictor plate 79 has peripheral portions which lie on the surfaces 82 and 83 of the cylinder 13, at least at the corners of the restrictor plate, for example. Accordingly, due to the previously mentioned relationship between the thickness of the keeper bars and the thickness of the restrictor plate, the valve plate is supported over the cylinder 13 by means of engagement of the restrictor plate on the surfaces 82 and 83 of the cylinder 13. The outer edges of the valve plate 26, as shown in FIG. 2A, do not necessarily engage the surfaces of the upstanding cylinder 13. The seal 81 is, however, sufficient to provide effective sealing between the valve plate and the cylinder 13, even though the valve plate may be slightly spaced away from the cylinder 13 by the engagement of the restrictor plate therebetween.

The restrictor plate 79 is provided preferably with four intake ports 86-89 and two exhaust ports 90 and 91. As best seen in FIGS. 2A and 11A, the intake ports 86, 87 and 88, 89 are disposed respectively on opposite sides of the intake valve receiving recess 71. Accordingly, when the reed 79 lifts off the intake ports 40, 41 of the valve plate 26, intake air can be drawn from the intake chamber 64 and the head 17 on either side of the reed 72 through the ports 86, 87 on one side of the reed and the ports 88, 89 on the other side of the reed. This prevents torsional twisting of the flexible reed and extends its useful life.

On the compression stroke of the piston 19, compressed air is forced outwardly through the exhaust ports 90, 91 in the restrictor plate through the exhaust port 42 in the valve plate 26 and past the free-floating exhaust reed 46 into the exhaust chamber 65 of the head 17. Thereafter, that compressed air is exhausted through the port 32 and into the intercooler 16.

Figure 12:
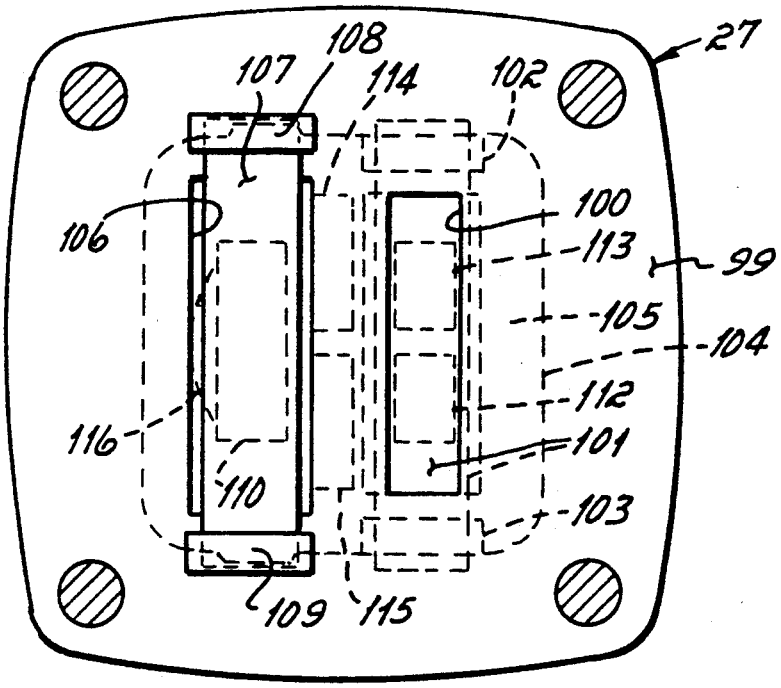
FIG. 12 is a cross-sectional view taken along lines 12—12 of FIG. 2, looking down onto the valve plate of the cylinder on the left side of FIG. 2.
Figure 13:
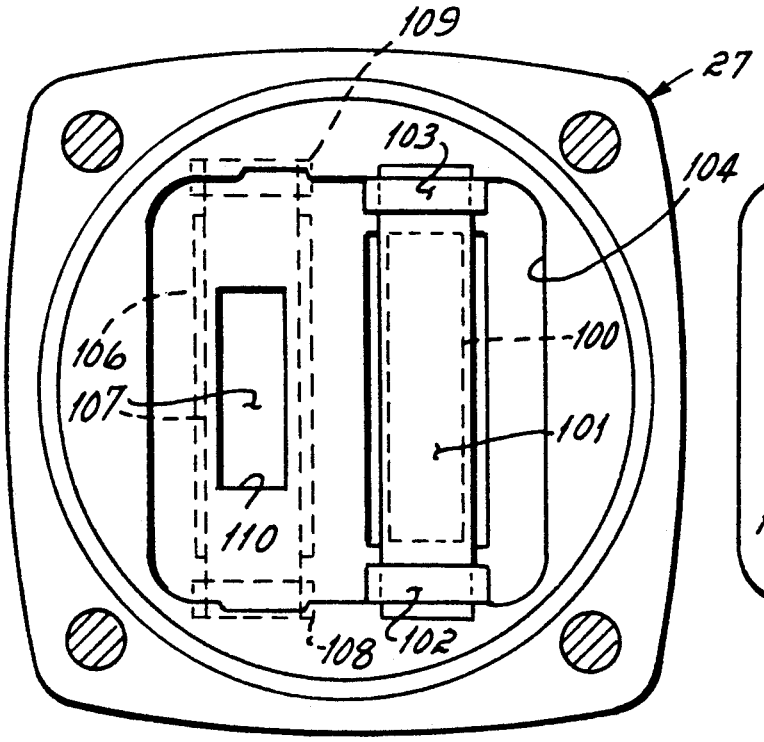
FIG. 13 is a cross-sectional view taken along lines 13—13 of FIG. 2, looking up onto the valve plate noted in FIG. 12, except with the restrictor plate omitted for clarify.
Figure 13A:
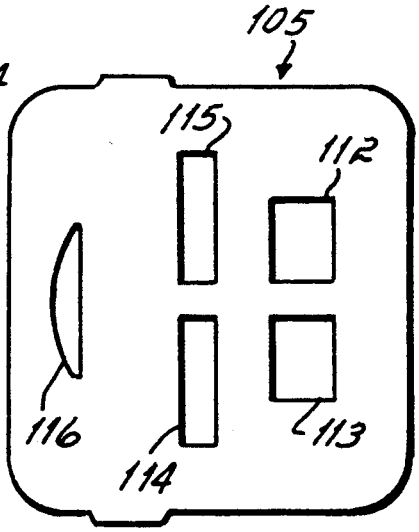
FIG. 13A is a view looking up into the restrictor plate, omitted for clarity, from FIG. 13.

Turning now to FIGS. 12, 13 and 13A, the valve plate 27 is associated with the second-stage cylinder 14 to control the valving of compressed air through the second stage. In this connection, compressed air from the expansible chamber 24 of the first stage has been moved through the intercooler 16, where the air is cooled, into an intake port 33 and into the intake chamber 95 of the head 18. From there, the compressed air moves into the expansible chamber 25 and is compressed into the exhaust chamber 96 of the head 18. The finally compressed air is exhausted from chamber 96 through the port 34 and the conduit for fitting 35.

The valve plate 27 and its free-floating intake and exhaust reed valves are constructed similarly to the valve plate 26 and its associated reed valves, with only two significant exceptions. The valve plate 27 is slightly smaller than the valve plate 26, and the restrictor plate 105, associated with the valve plate 27, has ports of different configuration than those shown with respect to the restrictor plate 79. For this reason, the detail of the relationship between the various free-floating reeds, the respective keeper bars, and the restrictor plate of the valve plate 27 are essentially the same as those shown for the valve plate 26 in FIGS. 2A and 6–10, and will not be repeated in similar additional figures.

The elements of valve plate 27 are primarily shown in FIGS. 12–13A. Valve plate 27 includes an exhaust side 99 facing the intake and exhaust chambers 95 and 96 of the head 18. An intake or compression side of the plate 27 faces the expansible chamber 25 defined in part by the cylinder 14 of the second compressor stage. The valve plate 27 includes an intake port 100, communicating with intake chamber 95 and a free-floating valve 101 constituting a flexible intake reed valve. The reed is movably captured between respective keeper bars 102 and 103, and is held at its ends in relieved areas extending from a recess cut into the compression side of the valve plate 27 for receiving the intake valve 101. The keeper bars 102 and 103 are slightly thicker than their receiving recesses and extend above the floor of a recess 104 for receiving a restrictor plate 105 (FIGS. 13 and 13A). The restrictor plate bottoms out on the keeper bars 102 and 103 and is of such a thickness as to extend slightly below the compression or intake side of the valve plate 27. In this regard, when the valve plate 27 is mounted on the cylinder 14, the restrictor plate engages upper surfaces of the cylinder 14 to hold the valve plate spaced slightly away from the cylinder. Nevertheless, peripheral seals similar to those as described with respect to valve plate 26 serve to seal the valve plate against the top of the cylinder, and chambers 95 and 96 from each other.

The valve plate 27 also includes a recess 106 for receiving a free-floating exhaust valve 107. Keeper bars 108 and 109 are disposed in relieved areas on either side of the recess 106, forming a discontinuous recess for each keeper bar. The thickness of the keeper bars is slightly greater than the recesses so that upper surfaces of the keeper bars extend above the exhaust side 99 of the valve plate 27. Moreover, there is a gap between the lower surfaces of the keeper bars 108 and 109. Reed 107 can float between the bottom of its recess and the bottom surfaces of its respective keeper bars, similarly to the same construction of plate 26, and similarly to the freefloating action of the reed intake valve 101 in its recess. An exhaust port 110 is provided in valve plate 27 through which finally compressed air is exhausted against the reed 107.

The restrictor plate 105 is perhaps best seen in FIG. 13A where it can be seen that the restrictor plate has two intake ports 112, 113, and three exhaust ports 114, 115 and 116. Accordingly, when the intake reed is drawn inwardly by the descending piston 20, air is pulled around the reed on both sides thereof through the respective ports 112 and 113. This prevents torsional twisting and undue wear and fatigue on the reed material.

The head 18 is provided with a reed valve stop surface 111 (FIG. 2) for engaging and holding the exhaust reed 107 as it is moved upwardly when compressed air is exhausted. The reed valve stop surface in head 18 is grooved, similarly to the stop surface in the head 17 for the first stage cylinder, in order to transmit air over the reed and prevent its deformation from air movement at the opposite reed edges from ports 114, 115 on one hand and port 116 on the other.

It will be appreciated that the restrictor plate 105 has peripheral edge surfaces which seat on the upper surfaces of the cylinder 14, thereby securing the keeper bars 102 and 103 in their proper position to maintain the intake valve in its proper condition. The head 18 also has keeper bar engaging surfaces for engaging the keeper bars 108 and 109 for freely capturing the exhaust valve reed 107 when the head, valve plate and cylinder are assembled.

Similarly to the first stage, the head 18, valve plate 27 and cylinder 14 do not contact each other, but rather are slightly spaced with the respective seals between the head and the valve plate on the one hand, and the valve plate and the cylinder on the other, forming effective seals. Accordingly, the head is bottomed out on the keeper bars in the valve plate, and if not tilted or slightly deformed is slightly spaced from the valve plate, while the valve plate is bottomed out by virtue of the relationship between the restrictor plate 105 and the keeper bars 102 and 103, the restrictor plate resting on the upper surfaces of the cylinder 14.

The particular construction of the valve plates and valves as described provide valving which has a number of advantages. First, the valves are capable of operation at high compressor speeds such as, for example, 1725 cpm. The keeper bars are hardened and are radiused so there is no defined flex line across the reeds and no undue wear placed on the free-floating reeds. The ends of the reed valves are not prone to cutting wear grooves in any surface, such as may lock the reed valve in an open or inoperable condition.

Figure 3:
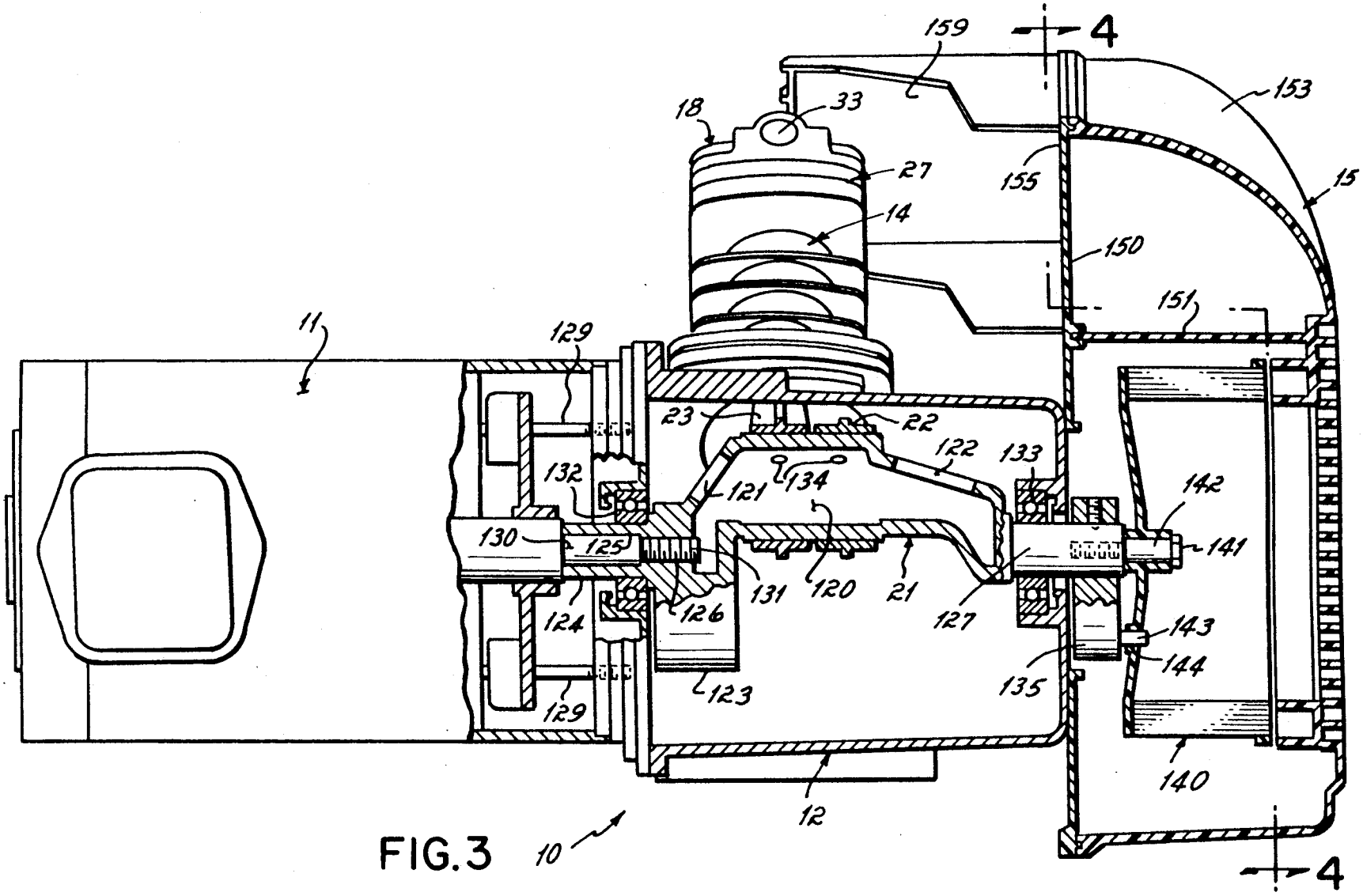
FIG. 3 is a cross-sectional view taken along lines 3—3 of FIG. 2.

Returning now to FIGS. 2 and 3, it will be further appreciated that the compressor is provided with an improved crankshaft for accomplishing several benefits. First, it will be noted in FIG. 3 that the crankshaft has a hollowed out or cored area 120. This hollowed out or cored area is open to the crankcase through large portals or openings such as shown at 121 and 122. Accordingly, oil in the crankcase 12 easily works its way into the cored center of the crankshaft 21. The crankshaft 21 is provided with an integral balance counterweight 123 thereon disposed at a driven end of the crankshaft. The driven end 124 of the crankshaft is provided with a bore 125 which is internally threaded at 126. The other driving end 127 of the crankshaft is not provided with any integral counterweight and thus the crankshaft 21 has an end 127 which are easily slipped through one-piece connecting rods 22 and 23, as shown in FIG. 3, for assembly. It is unnecessary to provide a composite connecting rod which may require other fasteners and could be subject to inadvertent separation during a compressor operation.

A motor 11 is connected by appropriate fastener means, such as bolts 129, to the crankcase 12. Motor 11 is provided with a rotatable drive shaft 130 having threads 131 on the end thereof for mating with the threads 126 in the driven end 124 of the crankshaft 21. A bearing 132 is disposed at the end 124 of the crankshaft outwardly of the counterweight 123. A second bearing 133 is disposed in the crankcase for mounting the other end of crankshaft 121 outwardly of the piston bearing surface which supports the connecting rods 22 and 23, and on the other side thereof from the counterweight 123.

It will be appreciated that the bore 125 in the crankshaft 21 extends completely through the driven end 124 of the crankshaft and into the cored or hollowed-out area 120. Accordingly, the threaded area 126 of the bore is open to internal area of the crankshaft and is in communication with any oil present therein. During operation, this oil tends to work its way into the threaded area and prevents fretting or corrosion between the material of the crankshaft 21 and threads 126, and the drive shaft 130 and its threads 131. Accordingly, the drive shaft 130 can be easily unthreaded from the crankshaft 21 for maintenance or for replacement of other parts. Moreover, it will be appreciated that the crankshaft 21 is also provided with lubricating ports 134 for the purpose of lubricating the outer crankshaft surfaces in the area of its connection to the one-piece connecting rods 22 and 23, thereby further promoting lubrication of the unit.

In order to provide for a sufficient dynamic balancing of the crankshaft 21, there is provided on the other end 127 a removable balance counterweight 135 (FIG. 3). This counterweight is of sufficient shape and angular disposition with respect to the crankshaft 21 as to provide for a sufficient dynamic balancing as the compressor is operated.

Moreover, it will be appreciated that the compressor 10 also includes a cooling fan 140 of the squirrel-cage type. This fan is secured to the crankshaft 21 at end 127 by means of an appropriate fastener 141 for rotation about a drive axis 142. In order to drive the fan, a drive pin 143 is extended from the counterweight 135 toward the fan 140 so as to engage a rear surface 144 of the fan in a driving relationship radially spaced from the drive axis 142.

Accordingly, the crankshaft 21 includes a cored area in conjunction with an integral counterweight and a drive shaft receiving bore whereby that bore is lubricated to prevent fretting and corrosion. The crankshaft is also adapted for utilization with one-piece piston connecting rods and is provided with a removable counterweight balance on an opposite end from the drive thereof, which counterweight is provided with drive means for driving the compressor cooling fan.

Figure 4:
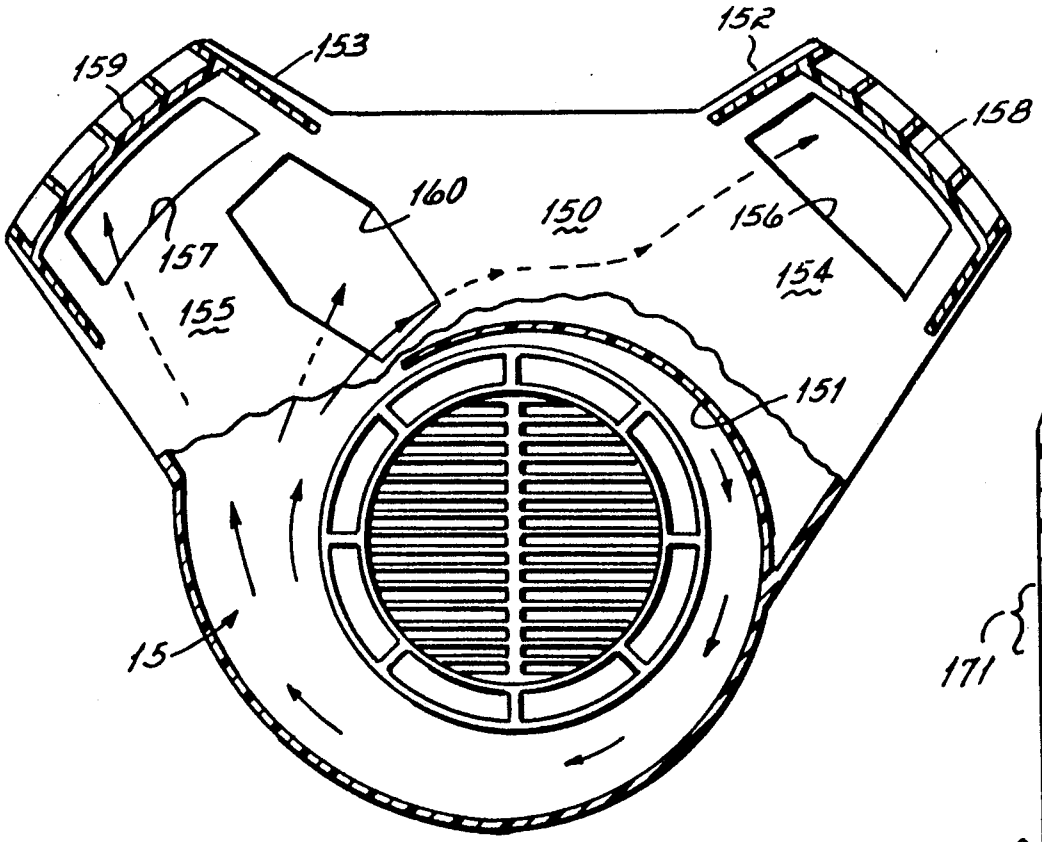
FIG. 4 is a cross-sectional view of the cooling fan shroud taken along liens 4—4 of FIG. 3.

In conjunction with the fan, the compressor 10 is provided with a shroud 15 for the purpose of efficiently directing air from the fan over both the cylinders' respective heads and the intercooler between the compressor stages defined by the cylinders. This shroud is perhaps best seen in FIGS. 1-4 and reference with respect to the shroud will be primarily had with respect to FIGS. 3 and 4. FIG. 4 shows the shroud 15 with a back plate 150 thereof being partially broken away to show the internal area of the shroud adjacent the fan.

The shroud includes a scroll vane 151 for the purpose of receiving air, drawn through the center of the fan and expelled at the fan periphery, and for directing that air up into a cooling air chamber defined by the shroud body and the back plate 150. The shroud comprises two projections 152 and 153 disposed in a V-shaped configuration in register with the V-shaped configuration of the cylinders 13 and 14 as shown in FIG. 2. The backing plate 150 is also provided with projections 154 and 155 corresponding to the projections 152 and 153 of the shroud. Cooling air exhaust ports 156 and 157 are disposed in the backing plate as best shown in FIG. 4. As shown by the arrows in FIG. 4, air is generated by the fan in a clockwise direction and up into the shroud chamber between the shroud body and the backplate 150. From there, the air is exhausted to the ports 156 and 157 toward the respective cylinders immediately therebehind.

In order to further cool the cylinders, deflectors 158 and 159 are provided on the backplate adjacent the respective ports 156 and 157. These direct air from the ports over the respective cylinders and heads. In addition, a third cool air exhaust port 160 is provided in the back plate 150 in general register with intercooler 16, extending between the two cylinders of the compressor. Upon operation of the fan, cooling air is thus also blown from the shroud and fan over the intercooler 16, thereby further cooling air which has been compressed and is moving for introduction into the second stage.

Figure 5:
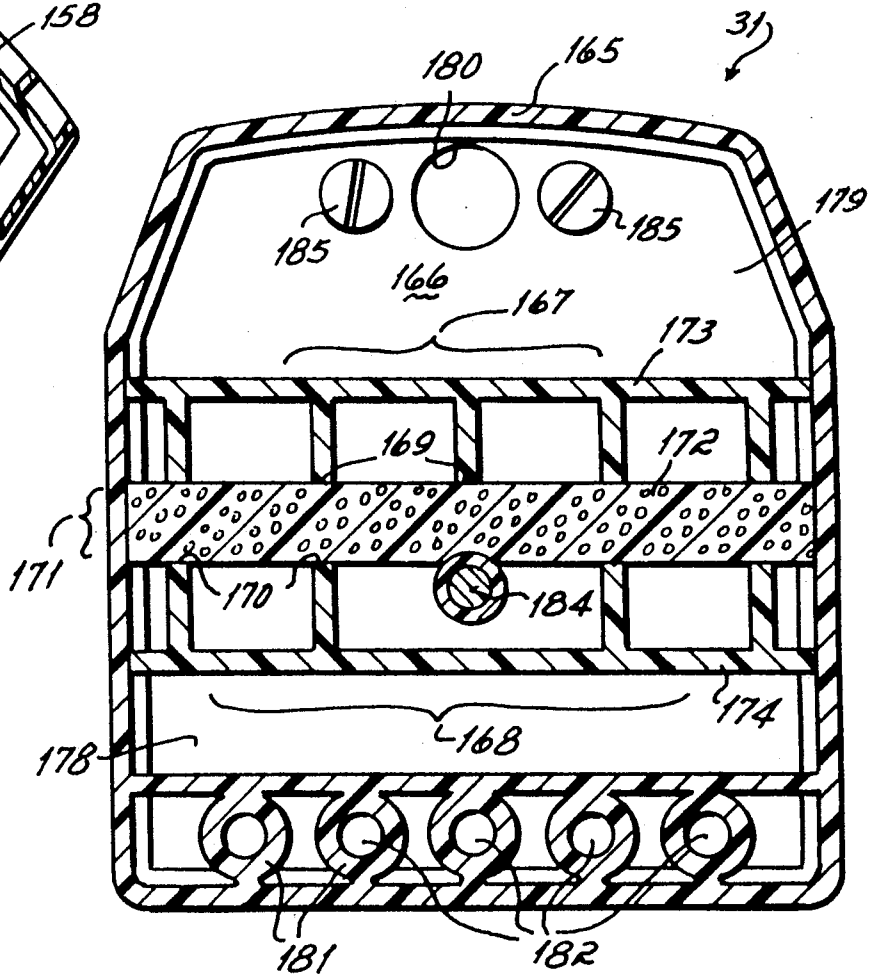
FIG. 5 is a cross-sectional view of the intake manifold taken along lines 5—5 of FIG. 2.

Turning now to FIGS. 2 and 5, it will be appreciated that the invention in another aspect includes an improved intake manifold 31. Intake manifold 31 is defined by a shroud 165 and a backing plate 166 defining an intake manifold chamber having an overall volume of about 50.08 cubic inches. Backing plate 166 is provided with two sets of ribs 167 and 168. The ribs in each of the sets have inwardly facing edges 169 and 170 defining therebetween a slot 171 for receiving a foam type or other suitable air filter 172. Walls 173 and 174 extend from the backing plate along the upper opposite edges of the respective sets of ribs to forward wall edges 175 and 176, respectively. The forward edges 175 and 176 of the walls 173 and 174 define between them, and the shroud 165, an air passageway 177 for the purpose of passing air from a first chamber 178 through the filter 172 to a second chamber 179 where the air can be exhausted from the manifold 31 through an exhaust port 180 into the intake chamber 64 of the head 17 (see FIG. 2A). Chambers 178 and 179 comprise portions of the overall intake manifold chamber noted above, together with a center chamber defined between the walls 173, 174. Chamber 178 has a volume of about 12.97 cubic inches. Chamber 179 has a volume of about 14.55 cubic inches. The remaining chamber between the walls 173, 174 has a volume of about 22.56 cubic inches.

Returning now to FIGS. 2 and 5, it will be appreciated that the shroud 165 is provided with a plurality of intake tubes 181 having air intake passageways 182 therethrough. Passageways 182 are about 0.312" in diameter, providing a cross-sectional flow are of about 0.0765 square inches. The tubes are about 2.188" long terminating at 183 within the first chamber 178.

Air inleted from the tubes expands into the first chamber 178 and then moves toward the air passageway 177, the filter 172 and chamber 179. The shroud is held onto the backing plate by means of elongated fastener 184, and the entire unit is secured to the head 17 by means of the fasteners 185.

The relationship of the various elements of the intake manifold to the elements of the specific preferred compressor described herein is such that the noise generated by the compressor is substantially muffled by the intake manifold. Of course, the intake manifold also serves to filter air by means of the air filter 172 which extends entirely across the manifold from the backing plate 166 to the shroud 165, as shown in FIG. 2.

It will also be appreciated that other similar manifolds of varying sizes can be used with compressors of other characteristics to provide both filtering and efficient sound muffling.

Accordingly, the invention provides, in a number of varied aspects, an improved compressor capable of operating at relatively high speed cycles of about 1725 cpm without undue valve wear and without losing efficiency due to valve operation. The capability of running the compressor at 1725 rpm, provided by the improved valve structure herein, also means that the compressor is run at the same design rpm of the drive motor 11, thereby eliminating any need for bulky and heavy speed reduction devices such as belt-driven pulleys. This further facilitates a more compact and lightweight compressor. At the same time, the invention provides an improved crankshaft which serves to prevent fretting and corrosion between the direct drive coupling of the drive motor to the crankshaft, and at the same time is suitable for use with one-piece piston connecting rods while providing means, in the form of a removable counterweight, for dynamic balancing of the crankshaft. The removable counterweight is also utilized in order to drive the compressor cooling fan and a shroud and backing plate serve to direct cooling air over each stage of the compressor as well as the intercooler therebetween. An improved intake manifold provides for both sound muffling and air filtering for air as it enters the first stage of the compressor.

It should be appreciated that the keeper bars and free-floating reed can be disposed within the head, the valve plate or the restrictor plate while still obtaining the advantage of the free-floating reed and of the separate keeper bars to provide an easily hardened and smooth surface for engagement of the opening reed.

Figure 14:
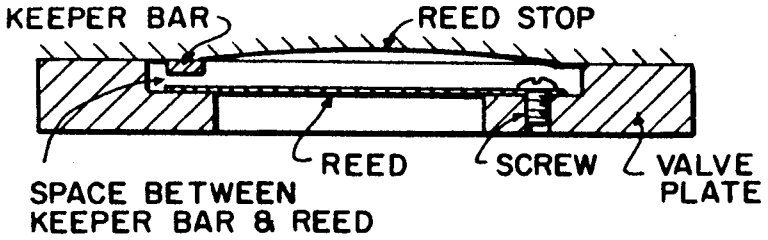
FIG. 14 is a diagrammatic illustration of a modified valve construction according to the invention.

It should also be appreciated that the invention with respect to the free-floating valve structure can be modified to provide an advantage in a fixed-end reed valve construction. In the past, the non-fixed end of a fixed reed valve was susceptible to impact or wear damage. The velocity of the reed flexure of such past valves led to fatigue and premature failure. According to the invention, the free end of a single fixed-end reed valve could be freely captured between its closed port position and an overlying keeper bar spaced therefrom (as described herein). As such a modified valve opens, its free end engages the keeper bar and slightly slides under it as the entire reed bows outwardly into a curved valve open configuration. This would eliminate the wear and impact damage caused by the free, but uncaptured, end of a fixed-end reed and would also reduce velocity and the fatiguing flexure of the reed both at its fixed end and throughout the whole reed, thereby prolonging its life. Such a construction is shown diagrammatically in FIG. 14.

These and other embodiments and alterations thereof will be readily appreciated by those of ordinary skill in the art without departing from the scope of this invention, and applicant intends to be bound only by the claims appended hereto.

What is claimed is:

1. An air compressor having two cylinders in V-shaped configuration mounted on a crankcase, an intercooler disposed between said cylinders for conducting air from one cylinder to the other, a fan mounted at an end of said crankcase and a fan shroud operably disposed about said fan, and said shroud further including:

a scroll-shaped vane disposed around said fan for directing air from said fan;

two projections extending upwardly in V-shaped configuration from said shroud;

cooling air discharge passageways extending from said fan and vane into said shroud projections;

a shroud back plate having two projections in V-shaped configuration corresponding to said shroud projections, said plate closing off said shroud and forming with said shroud a cooling air chamber for receiving cooling air from said fan and vane;

transverse exhaust ports in ends of the backplate projections for exhausting cooling air from said chamber;

deflector means disposed in operable alignment with said exhaust ports for directing cooling air over said respective cylinders; and a further exhaust port disposed in said back plate in general register with said intercooler means for directing cooling air from within said shroud over said intercooler.

* * * * *

UNITED STATES PATENT AND TRADEMARK OFFICE

CERTIFICATE OF CORRECTION

PATENT NO. : 5,020,973

DATED : June 4, 1991

INVENTOR(S) : James B. Lammers

It is certified that error appears in the above-identified patent and that said Letters Patent is hereby corrected as shown below:

Title page:

Item: "[73] Assignee: THE SCOTT & FETZER COMPANY
Lakewood, Ohio"

at page 1, column 1 of the patent, is changed to read

"[73] Assignee: Campbell Hausfeld/Scott Fetzer Company"

Signed and Sealed this

Twenty-third Day of March, 1993

*Attest:*

STEPHEN G. KUNIN

*Attesting Officer*

*Acting Commissioner of Patents and Trademarks*